US010167665B2

(12) United States Patent
Kuster et al.

(10) Patent No.: US 10,167,665 B2
(45) Date of Patent: Jan. 1, 2019

(54) SPACER FOR INSULATING GLAZING UNITS, COMPRISING EXTRUDED PROFILED SEAL

(71) Applicant: SAINT-GOBAIN GLASS FRANCE, Courbevoie (FR)

(72) Inventors: Hans-Werner Kuster, Aachen (DE); Walter Schreiber, Aachen (DE); Rino Messere, Modave (BE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 132 days.

(21) Appl. No.: 15/038,298

(22) PCT Filed: Dec. 5, 2014

(86) PCT No.: PCT/EP2014/076739
§ 371 (c)(1),
(2) Date: May 20, 2016

(87) PCT Pub. No.: WO2015/086459
PCT Pub. Date: Jun. 18, 2015

(65) Prior Publication Data

US 2016/0290032 A1 Oct. 6, 2016

(30) Foreign Application Priority Data

Dec. 12, 2013 (EP) ..... 13196865

(51) Int. Cl.
*E06B 3/663* (2006.01)
*E06B 3/673* (2006.01)
(Continued)

(52) U.S. Cl.
CPC ..... *E06B 3/66328* (2013.01); *E06B 3/66319* (2013.01); *E06B 3/6733* (2013.01);
(Continued)

(58) Field of Classification Search
CPC .. E06B 3/66328; E06B 3/66319; E06B 3/673; E06B 3/6773; E06B 3/66366; E06B 3/6715
See application file for complete search history.

(56) References Cited

U.S. PATENT DOCUMENTS 2,094,381 A 9/1937 Games
2,303,897 A 12/1942 Smith
(Continued)

FOREIGN PATENT DOCUMENTS

CA 2275448 A1 7/1998
CN 1377329 A 10/2002
(Continued)

OTHER PUBLICATIONS

Amcor "Ceramis Coating Technology" Oct. 2012, available at http://www.amcor.com/CMSPages/GetFile.aspx?guid=dbab33c8-3471-4e86-aa69-57dc76b525c1. 12 pages.
(Continued)

*Primary Examiner* — Donald J Loney
(74) *Attorney, Agent, or Firm* — Steinfl + Bruno LLP

(57) ABSTRACT

A spacer for insulating glazing units is described. The sealing arrangement includes a polymer base; which includes two pane contact surfaces, a glazing interior space surface and an outer surface and an extruded profiled seal on the outer surface, the extruded profiled seal and the polymer base being co-extruded.

12 Claims, 3 Drawing Sheets

Figure 1A:
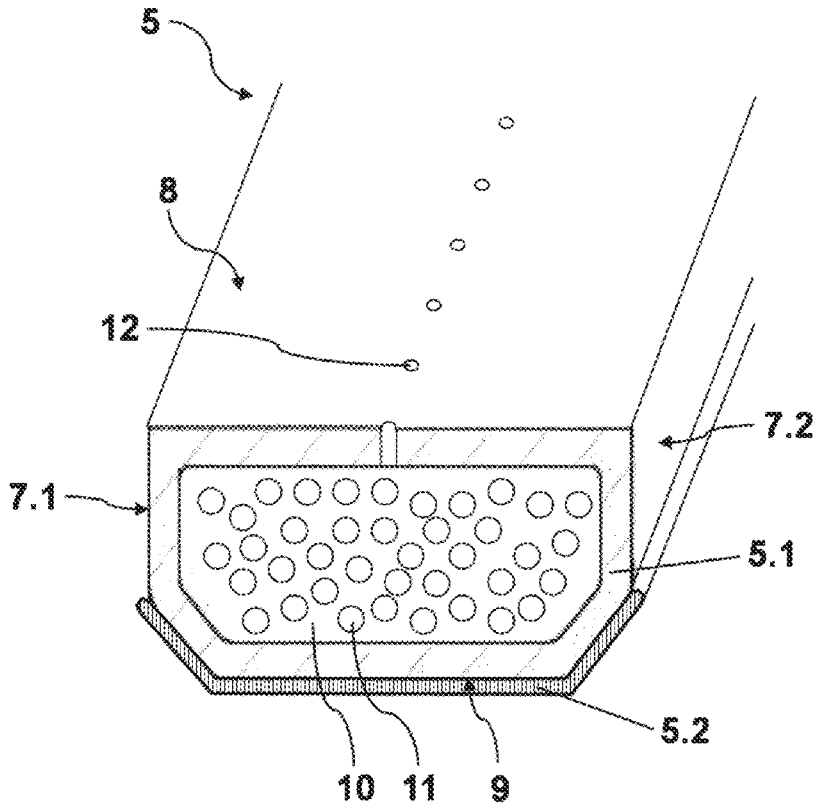

(51) Int. Cl.
*E06B 3/667* (2006.01)
*E06B 3/67* (2006.01)

(52) U.S. Cl.
CPC ..... *E06B 3/667* (2013.01); *E06B 3/66366* (2013.01); *E06B 3/673* (2013.01); *E06B 3/6715* (2013.01); *E06B 2003/6638* (2013.01)

(56) References Cited

U.S. PATENT DOCUMENTS 2,834,999 A 5/1958 Taylor et al.
3,168,089 A 2/1965 Larkin
3,793,276 A 2/1974 Blunt et al.
3,935,683 A 2/1976 Derner et al.
3,998,680 A 12/1976 Flint
4,080,482 A 3/1978 Lacombe
4,109,431 A 8/1978 Mazzoni et al.
4,198,254 A 4/1980 Laroche et al.
4,226,063 A 10/1980 Chenel
4,479,988 A 10/1984 Dawson
4,613,530 A 9/1986 Hood et al.
4,658,553 A 4/1987 Shinagawa
4,799,745 A 1/1989 Meyer et al.
4,831,799 A 5/1989 Glover et al.
5,007,217 A 4/1991 Glover et al.
5,071,206 A 12/1991 Hood et al.
5,079,054 A 1/1992 Davies
5,125,195 A 6/1992 Brede
5,173,800 A 12/1992 King
5,209,034 A 5/1993 Box et al.
5,270,092 A 12/1993 Griffith et al.
5,290,611 A 3/1994 Taylor et al.
5,302,425 A 4/1994 Taylor
5,313,762 A 5/1994 Guillemet
5,424,111 A 6/1995 Farbstein
5,439,716 A 8/1995 Larsen
5,460,862 A 10/1995 Roller
5,512,341 A 4/1996 Newby et al.
5,655,282 A 8/1997 Hodek et al.
5,679,419 A 10/1997 Larsen
5,759,665 A 6/1998 Lafond
5,773,135 A 6/1998 Lafond
5,851,627 A 12/1998 Farbstein
5,962,090 A 10/1999 Trautz
6,001,453 A 12/1999 Lafond
6,002,521 A 12/1999 Town
6,060,178 A 5/2000 Krisko
6,061,994 A 5/2000 Goer et al.
6,115,989 A 9/2000 Boone et al.
6,223,414 B1 5/2001 Hodek et al.
6,250,045 B1 6/2001 Goer et al.
6,250,245 B1 6/2001 Robinson et al.
6,266,940 B1 7/2001 Reichert
6,339,909 B1 1/2002 Brunnhofer et al.
6,351,923 B1 3/2002 Peterson
6,389,779 B1 5/2002 Brunnhop
6,391,400 B1 5/2002 Russell et al.
6,457,294 B1 10/2002 Virnelson et al.
6,503,617 B2 1/2003 Jacobsen et al.
6,528,131 B1 * 3/2003 Lafond ..... E06B 3/66328 428/34
6,537,629 B1 3/2003 Ensinger
6,613,404 B2 9/2003 Johnson
6,796,102 B2 9/2004 Virnelson et al.
6,989,188 B2 * 1/2006 Brunnhofer ..... E06B 3/66319 428/188
7,317,280 B2 1/2008 Qiu et al.
7,827,760 B2 11/2010 Brunnhofer et al.
7,858,193 B2 12/2010 Ihlo et al.
7,997,037 B2 8/2011 Crandell et al.
8,453,415 B2 6/2013 Brunnhofer et al.
8,484,912 B2 7/2013 Engelmeyer
8,640,406 B2 2/2014 Brunnhofer et al.
9,085,708 B2 7/2015 Becker et al.
9,260,906 B2 2/2016 Schreiber
9,487,994 B2 11/2016 Lenz et al.
2001/0001357 A1 5/2001 Reichert
2002/0192473 A1 12/2002 Gentilhomme et al.
2003/0074859 A1 4/2003 Reichert et al.
2004/0028953 A1 2/2004 Kraemling
2004/0076815 A1 4/2004 Reichert
2004/0163347 A1 8/2004 Hodek et al.
2004/0256978 A1 12/2004 Yu et al.
2005/0034386 A1 2/2005 Crandell et al.
2005/0100691 A1 5/2005 Bunnhofer et al.
2005/0170161 A1 8/2005 Ramchandra et al.
2005/0214487 A1 9/2005 Trautz
2005/0287370 A1 12/2005 Kaczmarek et al.
2006/0003138 A1 1/2006 Kaczmarek et al.
2006/0130427 A1 6/2006 Hodek et al.
2006/0150577 A1 7/2006 Hodek et al.
2006/0162281 A1 7/2006 Pettit et al.
2006/0260227 A1 11/2006 Winfield
2007/0087140 A1 4/2007 Dierks
2007/0122572 A1 5/2007 Shibuya et al.
2007/0251180 A1 11/2007 Gosling et al.
2007/0261358 A1 11/2007 Davis et al.
2007/0261795 A1 11/2007 Rosskamp et al.
2008/0053037 A1 3/2008 Gallagher
2008/0134596 A1 6/2008 Brunnhofer et al.
2009/0120019 A1 5/2009 Trpkovski
2009/0120035 A1 5/2009 Trpkovski
2009/0139165 A1 6/2009 Prete et al.
2009/0186213 A1 7/2009 Ihlo et al.
2009/0197077 A1 8/2009 Reutler et al.
2009/0243802 A1 10/2009 Wolf et al.
2009/0301637 A1 12/2009 Reichert
2010/0011703 A1 1/2010 Seele et al.
2010/0107529 A1 5/2010 Engelmeyer
2011/0041427 A1 2/2011 Bouesnard
2011/0275796 A1 11/2011 Seilz et al.
2012/0141699 A1 6/2012 Mader
2012/0192946 A1 8/2012 Becker et al.
2012/0297707 A1 11/2012 Lenz et al.
2012/0297708 A1 11/2012 Brunnhofer et al.
2013/0079446 A1 3/2013 Becker et al.
2014/0272207 A1 9/2014 McKenna et al.
2014/0311065 A1 10/2014 Schreiber
2014/0356557 A1 12/2014 Reichert
2015/0107167 A1 4/2015 Baumann et al.
2016/0069123 A1 3/2016 Schreiber
2016/0201381 A1 7/2016 Kuster et al.
2016/0290032 A1 10/2016 Kuster et al.
2016/0290033 A1 10/2016 Messere
2017/0145734 A1 5/2017 Kuster et al.
2017/0152701 A1 6/2017 Kuster et al.
2018/0058139 A1 3/2018 Schwerdt et al.

FOREIGN PATENT DOCUMENTS

CN 1678810 A 10/2005
DE 2555384 C3 3/1982
DE 3302659 A1 8/1984
DE 2752542 C2 10/1989
DE 40 24 697 A1 2/1992
DE 9408794 U1 10/1995
DE 19533685 A1 3/1997
DE 19602455 A1 7/1997
DE 19625845 A1 1/1998
DE 198 05 348 A1 8/1999
DE 198 07 454 A1 8/1999
DE 69607473 T2 9/2000
DE 19927683 C1 1/2001
DE 10025321 A1 1/2002
DE 10356216 A1 7/2005
DE 69633132 T2 8/2005
DE 102009006062 A1 7/2010
DE 102009057156 A1 6/2011
DE 102010006127 A1 8/2011
DE 20 2012 104026 U1 10/2013
EP 0078530 A2 5/1983
EP 0154428 A2 9/1985
EP 0261923 A2 3/1988
EP 0430889 A2 6/1991

(56) References Cited

FOREIGN PATENT DOCUMENTS

| | | | |
|---|---|---|---|
| EP | 0 852 280 | A1 | 7/1998 |
| EP | 0865560 | B1 | 8/2004 |
| EP | 1607216 | A1 | 12/2005 |
| EP | 1607217 | A1 | 12/2005 |
| EP | 0912455 | B1 | 5/2006 |
| EP | 1892365 | A1 | 2/2008 |
| EP | 1218307 | B1 | 7/2008 |
| EP | 1917222 | B1 | 3/2009 |
| EP | 2218862 | A2 | 8/2010 |
| EP | 2270307 | A2 | 1/2011 |
| EP | 2 363 565 | A2 | 9/2011 |
| EP | 2420536 | A1 | 2/2012 |
| EP | 2584135 | A2 | 4/2013 |
| EP | 2628884 | A2 | 8/2013 |
| EP | 2802726 | B1 | 4/2016 |
| FR | 2205620 | A1 | 5/1974 |
| FR | 2799005 | A1 | 3/2001 |
| GB | 2103999 | A | 3/1983 |
| GB | 2210899 | A | 6/1989 |
| JP | H09175843 | A | 7/1997 |
| JP | H11189439 | A | 7/1999 |
| JP | 2008-019131 | A | 1/2008 |
| WO | 97/48649 | A1 | 12/1997 |
| WO | 98/28513 | A1 | 7/1998 |
| WO | 01/16046 | A1 | 3/2001 |
| WO | 2004/005783 | A2 | 1/2004 |
| WO | 2007/042688 | A1 | 4/2007 |
| WO | 2007/101964 | A1 | 9/2007 |
| WO | 2008/022877 | A1 | 2/2008 |
| WO | 2010/034781 | A2 | 4/2010 |
| WO | 2010/115456 | A1 | 10/2010 |
| WO | 2011/088994 | A2 | 7/2011 |
| WO | 2012/095266 | A1 | 7/2012 |
| WO | 2012/140005 | A1 | 10/2012 |
| WO | 2013/104507 | A1 | 7/2013 |
| WO | 2014/198429 | A1 | 12/2014 |
| WO | 2014/198431 | A1 | 12/2014 |

OTHER PUBLICATIONS

Final Office Action for U.S. Appl. No. 14/357,164, filed May 8, 2014 on behalf of Walter Schreiber. dated Feb. 9, 2015. 16 pages.
Non-Final Office Action for U.S. Appl. No. 14/357,164, filed May 8, 2014 on behalf of Walter Schreiber. dated Aug. 10, 2015. 14 pages.
Non-Final Office Action for U.S. Appl. No. 14/357,164, filed May 8, 2014 on behalf of Walter Schreiber. dated Sep. 10, 2014. 24 pages.
Notice of Allowance for U.S. Appl. No. 14/357,164, filed May 8, 2014 on behalf of Walter Schreiber. dated Jun. 22, 2015. 8 pages.
Notice of Allowance for U.S. Appl. No. 14/357,164, filed May 8, 2014 on behalf of Walter Schreiber. dated May 18, 2015. 12 pages.
Notice of Allowance for U.S. Appl. No. 14/357,164, filed May 8, 2014 on behalf of Walter Schreiber. dated Nov. 23, 2015. 14 pages.
Notice of Allowance for U.S. Appl. No. 14/357,164, filed May 8, 2014 on behalf of Walter Schreiber. dated Sep. 28, 2015. 12 pages.
Non-Final Office Action for U.S. Appl. No. 14/942,902, filed Nov. 16, 2015 on behalf of Walter Schreiber. dated Mar. 10, 2016. 28 pages.
Written Opinion for International Application No. PCT/EP2012/076341 filed Dec. 20, 2012 on behalf of Saint-Gobain Glass France. dated Feb. 8, 2013. (German original + English Translation) 15 pages.
International Search Report for International Application No. PCT/EP2012/076341 filed Dec. 20, 2012 on behalf of Saint-Gobain Glass France. dated Feb. 8, 2013. (German original + English Translation) 6 pages.
International Preliminary Report on Patentability for International Application No. PCT/EP2012/076341 filed Dec. 20, 2012 on behalf of Saint-Gobain Glass France. dated Jul. 15, 2014. (German original + English Translation) 17 pages.
Written Opinion for International Application No. PCT/EP2014/053714 filed Feb. 26, 2014 on behalf of Saint-Gobain Glass France. dated Mar. 25, 2014. (German original + English Translation) 10 pages.
International Search Report for International Application No. PCT/EP2014/053714 filed Feb. 26, 2014 on behalf of Saint-Gobain Glass France. dated Mar. 25, 2014. (German original + English Translation) 7 pages.
Written Opinion for International Application No. PCT/EP2014/054710 filed Mar. 11, 2014 on behalf of Saint-Gobain Glass France. dated Apr. 4, 2014. (German original + English Translation) 12 pages.
International Search Report for International Application No. PCT/EP2014/054710 filed Mar. 11, 2014 on behalf of Saint-Gobain Glass France. dated Apr. 4, 2014. (German original + English Translation) 5 pages.
Written Opinion for International Application No. PCT/EP2014/067901 filed Aug. 22, 2014 on behalf of Saint-Gobain Glass France. dated Oct. 7, 2014. (German original + English Translation) 13 pages.
International Search Report for International Application No. PCT/EP2014/067901 filed Aug. 22, 2014 on behalf of Saint-Gobain Glass France. dated Oct. 7, 2014. (German original + English Translation) 5 pages.
International Search Report for International Application No. PCT/EP2014/076739 filed on Dec. 5, 2014 in the name of Saint-Gobain Glass France. dated Feb. 3, 2015 (English translation & German original).
Advisory Action issued for U.S. Appl. No. 14/942,902, filed Nov. 16, 2015 on behalf of Saint-Gobain Glass France. dated Jan. 5, 2017. 4 pages.
International Search Report for International Patent Application PCT/EP2014/076736, filed Dec. 5, 2014 on behalf of Saint-Gobain Glass France. dated Mar. 10, 2016. 5 pages (German Original + English Translation).
International Search Report for International Patent Application PCT/EP2015/063814, filed Jun. 15, 2015 on behalf of Saint-Gobain Glass France. dated Aug. 14, 2015. 5 pages (German Original + English Translation).
International Search Report for International Patent Application PCT/EP2015/063821, filed Jun. 19, 2015 on behalf of Saint-Gobain Glass France. dated Aug. 19, 2015. 5 pages (German Original + English Translation).
International Search Report for International Patent Application PCT/EP2016/054226, filed Feb. 29, 2016 on behalf of Saint-Gobain Glass France. dated May 3, 2016. 5 pages (German Original + English Translation).
Non-Final Office Action for U.S. Appl. No. 15/038,356, filed May 20, 2016 on behalf of Saint-Gobain Glass France. dated Feb. 22, 2018. 7 pages.
Non-Final Office Action for U.S. Appl. No. 14/942,902, filed Nov. 16, 2015 on behalf of Saint-Gobain Glass France. dated Apr. 4, 2017. 23 pages.
Non-Final Office Action for U.S. Appl. No. 14/942,902, filed Nov. 16, 2015 on behalf of Saint-Gobain Glass France. dated Jan. 3, 2018. 20 pages.
Non-Final Office Action for U.S. Appl. No. 14/909,073, filed Jan. 29, 2016 on behalf of Saint-Gobain Glass France. dated Apr. 4, 2017. 23 pages.
Non-Final Office Action for U.S. Appl. No. 14/909,073, filed Jan. 29, 2016 on behalf of Saint-Gobain Glass France. dated Aug. 25, 2017. 26 pages.
Non-Final Office Action for U.S. Appl. No. 15/321,161, filed Dec. 21, 2016 on behalf of Saint-Gobain Glass France. dated Mar. 20, 2018. 15 pages.
Non-Final Office Action for U.S. Appl. No. 15/321,170, filed Dec. 21, 2016 on behalf of Saint-Gobain Glass France. dated Mar. 22, 2018. 24 pages.
Final Office Action for U.S. Appl. No. 14/942,902, filed Nov. 16, 2015 on behalf of Saint-Gobain Glass France. dated Sep. 26, 2016. 33 pages.

(56) References Cited

OTHER PUBLICATIONS

Final Office Action for U.S. Appl. No. 14/942,902, filed Nov. 16, 2015 on behalf of Saint-Gobain Glass France. dated Sep. 12, 2017. 29 pages.
Final Office Action for U.S. Appl. No. 14/909,073, filed Jan. 29, 2016 on behalf of Saint-Gobain Glass France. dated Jun. 20, 2017. 25 pages.
Restriction Requirement for U.S. Appl. No. 15/038,356, filed May 20, 2016 on behalf of Saint-Gobain Glass France. dated Jan. 16, 2018. 7 pages.
Sua Sponte Withdrawal issued for U.S. Appl. No. 14/942,902, filed Nov. 16, 2015 on behalf of Saint-Gobain Glass France. dated Feb. 2, 2018. 2 pages.
Written Opinion for International Application No. PCT/EP2014/076739 filed on Dec. 5, 2014 in the name of Saint-Gobain Glass France. dated Feb. 3, 2015. 14 pages (German Original + English Translation).
Written Opinion for International Application No. PCT/EP2014/076736 filed on Dec. 5, 2014 in the name of Saint-Gobain Glass France. dated Mar. 10, 2016. 10 pages (German Original + English Translation).
Written Opinion for International Patent Application PCT/EP2015/063814, filed Jun. 15, 2015 on behalf of Saint-Gobain Glass France. dated Aug. 14, 2015. 16 pages (German Original + English Translation).
Written Opinion for International Patent Application PCT/EP2015/063821, filed Jun. 19, 2015 on behalf of Saint-Gobain Glass France. dated Aug. 19, 2015. 16 pages (German Original + English Translation).
Written Opinion for International Patent Application PCT/EP2016/054226, filed Feb. 29, 2016 on behalf of Saint-Gobain Glass France. dated May 3, 2016. 9 pages (German Original + English Translation).
Non-Final Office Action for U.S. Appl. No. 14/942,902, filed Nov. 16, 2015 on behalf of Saint-Gobain Glass France. dated Apr. 2, 2018. 19 pages.
Bishop, C.A. et al., "Metallizing Technical Reference", AIMCAL, May 2012. Title and pp. 21-25.
Phaneuf, M.W., "Applications of Focused Ion Beam Microscopy to Materials Science Specimens", Micron 30. Jan. 28, 1999. pp. 277-288.
Zimmermann, M.—7$^{th}$ International Vacuum Insulation Symposium 205, Table of Contents, pp. 1 to 4, Switzerland, Sep. 2005, 4 pages.
Delstar Technologies online catalog, Delstar catalogs Delnet as a "Nets/Mesh/Apertured Film" Downloaded from the internet on Feb. 14, 2017. 1 page. (http://extrudedfilmsandnets.co.uk/product-types/nets-mesh-apertured-film).
Delstar Technologies online catalog, Delstar catalogs Delnet as a "Search/Category-all/Net" Downloaded from the internet on Feb. 14, 2017. 1 page. (http://extrudedfilmsandnets.co.uk/products/finder/search/category-all/net).
Opposition by opponent HELIMA GMBH in European Patent 2,802,7269 B1, issued Aug. 22, 2017 to Saint-Gobain Glass France. Mail Date: Nov. 24, 2017. 14 pages. (German Original + English Translation).
Response to notices of opposition against European Patent EP 2 802 726 B1 by the companies Technoform Glass Insulation Holding GmbH (01), Ensinger GmbH (02), Camvac Limited (03), Thermoseal Group Limited (04), ROLLTECH A/S (05), Helima GmbH (06). Mail Date: Aug. 22, 2017. 119 pages. (English Translation + German Original).
Opposition by opponent Camvac Limited in European Patent 2,802,726 B1, issued Apr. 27, 2016 to Saint-Gobain Glass France. Mail date: Jan. 27, 2017. 16 pages.
Annex A to opposition by opponent Camvac Limited. "Press notes and articles from 2011". May-Aug. 2011. 4 pages.
Annex B to opposition by opponent Camvac Limited. "Invoices and delivery notes from Thermoseal Group Ltd from Aug. 2011 to Dec. 2011". Aug.-Dec. 2011. 24 pages.
Annex BB to opposition by opponent Camvac Limited. "Invoice and delivery note from Thermoseal Group Ltd of Aug. 2011". Aug. 2011. 2 pages.
Annex C1 to opposition by opponent Camvac Limited. "Thermobar production sheets from Thermoseal Group Ltd of Dec. 22, 2011 and Dec. 23, 2011". Dec. 22 and 23, 2011. 2 pages.
Annex C2 to opposition by opponent Camvac Limited. "Stock Control from Thermoseal Group Ltd from Jun. 8, 2011 to Dec. 22, 2011". Jun. 8, 2011-Dec. 22, 2011. 14 pages.
Annex C3 to opposition by opponent Camvac Limited. "Invoices No. 47197, 47486 and 47812 from Lohmann of Jun. 30, 2011, Aug. 26, 2011 and Oct. 31, 2011". Jun. 30, 2011, Aug. 26, 2011, and Oct. 31, 2011. 3 pages.
Annex CC1 to opposition by opponent Camvac Limited. "Thermobar production sheets from Thermoseal Group Ltd of Aug. 8, 2011 and Sep. 26, 2011". Aug. 8, 2011 and Sep. 26, 2011. 2 pages.
Annex CC2 to opposition by opponent Camvac Limited. "Stock Control from Thermoseal Group Ltd of Jul. 29, 2011 and Sep. 6, 2011". Jul. 29, 2011 and Sep. 6, 2011. 1 page.
Annex CC3 to opposition by opponent Camvac Limited. "Invoice No. 47340 from Lohmann of Jul. 29, 2011". Jul. 29, 2011. 1 page.
Annex E to opposition by opponent Camvac Limited. "Delivery Notes with purchase order Nos. 7621, 7684, 7756, 7757 and 7832 from Camvac Limited of May 24, 2011, Jun. 8 and 29, 2011, Jul. 22, 2011 and Aug. 18, 2011". May 24, 2011, Jun. 8, 2011, Jun. 29, 2011, Jul. 22, 2011, and Aug. 18, 2011. 5 pages.
Annex F1A to opposition by opponent Camvac Limited. "Screen shot of Data Sheet 12/12 Cambrite film from Camvac". Jan. 19, 2017. 1 page.
Annex F1B to opposition by opponent Camvac Limited. "Declaration of Mr Gary Chalkley (Camvac Product Development Director)". Jan. 24, 2017. 1 page.
Annex F2 to opposition by opponent Camvac Limited. "Declaration of Mr. James Shipman (Camvac Process Development Manager)". Jan. 24, 2017. 2 pages.
Annex G to opposition by opponent Camvac Limited. "Data sheet PSI values for windows having a Thermobar Warm Edge Spacer". Nov. 2014. 1 page.
Opposition by opponent Ensinger GmbH in European Patent 2,802,726 B1, issued Apr. 27, 2016 to Saint-Gobain Glass France. Mail date: Jan. 27, 2017. 44 pages. (English Translation + German Original).
Annex D1A to opposition by opponent Ensinger GmbH. "Affidavit of Mr. Marc Rehling". Jan. 24, 2017. 4 pages. (English Translation + German Original).
Annex D1C to opposition by opponent Ensinger GmbH "Test Report AP 16-11-98". Nov. 2016. 16 pages. (English Translation + German Original).
Annex Die to opposition by opponent Ensinger GmbH. "ATR-Infrared Spectroscopy Measurement of the "Thermobar" Spacer". Dec. 12, 2016. 2 pages. (English Translation + German Original).
Annex D1F to opposition by opponent Ensinger GmbH. "Expert Opinion on "Thermobar" Spacer". Jan. 18, 2017. 14 pages. (English Translation + German Original).
Annex D2 to opposition by opponent Ensinger GmbH. "DIN EN ISO 10077-1 in the version dated May 2010". May 2010. 48 pages. (English Translation + German Original).
Annex D7 to opposition by opponent Ensinger GmbH. "Avis Technique [Technical Evaluation] 06/04- 1562 regarding the Super Spacer Premium and the Super Spacer Premium Plus the Edgetech Europe GmbH". Jan. 4, 2005. 46 pages. (English Translation + German Original).
Opposition by opponent Helima GmbH in European Patent 2,802,726 B1, issued Apr. 27, 2016 to Saint-Gobain Glass France. Mail date: Jan. 27, 2017. 159 pages. (English Translation + German Original).
Supplement to opposition by opponent Helima GmbH in European Patent 2,802,726 B1, issued Apr. 27, 2016 to Saint-Gobain Glass France. Mail date: Mar. 23, 2017. 6 pages. (English Translation + German Original).
Annex A1 to opposition by opponent Helima GmbH. "Excerpt from the website of the company Viking regarding Window DK88". Sep. 2012. 4 pages.

(56) References Cited

OTHER PUBLICATIONS

Annex A2 to opposition by opponent Helima GmbH. "Excerpt from the Polish website of the patent holder". Nov. 12, 2012. 3 pages. (English Translation + German Original).
Annex A3 to opposition by opponent Helima GmbH. "Technical Opinion 6/13- 2124*01 Add of the CSTB". Sep. 24, 2014. 60 pages (English Translation + French Original).
Annex A4 to opposition by opponent Helima GmbH. "Technical Opinion 06/16-2303 of the CSTB". Jun. 30, 2016. 62 pages. (English Translation + French Original).
Annex A5 to opposition by opponent Helima GmbH. "Datasheet Swisspacer Ultimate". Apr. 2013. 2 pages. (English Translation + German Original).
Annex A6 to opposition by opponent Helima GmbH. "Excerpt from AIMCAL "Metallizing Technical Reference"". May 2012. 2 pages.
Annex A7 to opposition by opponent Helima GmbH. "Excerpt from Frick/Knoll: Baukonstruktionslehre [Structural Design Theory] 2, Ed.34". Hestermann and Rongen, "Frick/Knöll Baukonstruktionslehre 2", pp. 371-372, 2013. 10 pages. (English Translation + German Original).
Annex A8 to opposition by opponent Helima GmbH. "Affidavit". Jan. 27, 2017. 2 pages.
Annex A9 to opposition by opponent Helima GmbH. "Datasheet Sanco ACS Thermix". Jun. 2009. 5 pages. (English Translation + German Original).
Annex A10 to opposition by opponent Helima GmbH. "Barrier films for vacuum insulation panels (VIP)". Kaczmarek, "Barrier films for vacuum insulation panels (VIP)", 7th International Vacuum Insulation Symposium 2005, pp. 91-98, 2005. 8 pages.
Opposition by opponent Rolltech A/S in European Patent 2,802,726 B1, issued Apr. 27, 2016 to Saint-Gobain Glass France. Mail date: Jan. 27, 2017. 32 pages.
Annex O1i to opposition by opponent Rolltech A/S. "Ceramis Barrier Films by Alcan Packaging". Mar. 2005. 4 pages.
Annex O1ii to opposition by opponent Rolltech A/S. "'Barrier Films: SiOx Barrier Benefits' by Marius Breune in Paper, Film & Foil Converter". Oct. 1, 2010. 4 pages.
Opposition by opponent Technoform Glass Insulation Holding GmbH in European Patent 2,802,726 B1, issued Apr. 27, 2016 to Saint-Gobain Glass France. Mail Date: Jan. 26, 2017. 55 pages. (English Translation + German Original).
Annex E6a to opposition by opponent Technoform Glass Insulation Holding GmbH. "ISO 10077-1 in the version of 2006". Sep. 15, 2006. 42 pages.
Annex E6b to opposition by opponent Technoform Glass Insulation Holding GmbH. "ISO 10077-2 in the version of 2012". Mar. 1, 2012. 44 pages.
Annex E6c to opposition by opponent Technoform Glass Insulation Holding GmbH. "two data sheets Saint-Gobain Swisspacer from 2008". Oct. 2008. 2 pages.
Opposition by opponent Thermoseal Group Ltd in European Patent 2,802,726 B1, issued Apr. 27, 2016 to Saint-Gobain Glass France. Mail date: Jan. 27, 2017. 20 pages.
Annex A to opposition by opponent Thermoseal Group Ltd. "Press notes and articles from 2011". May-Sep. 2011. 4 pages.
Annex B to opposition by opponent Thermoseal Group Ltd. "Invoices and delivery notes from Thermoseal Group Ltd from Aug. 2011 to Dec. 2011". Aug.-Dec. 2011. 24 pages.
Annex BB to opposition by opponent Thermoseal Group Ltd. "Invoice and delivery note from Thermoseal Group Ltd of Aug. 2011". Aug. 2011. 2 pages.
Annex C1 to opposition by opponent Thermoseal Group Ltd. "Thermobar production sheets from Thermoseal Group Ltd of Dec. 22, 2011 and Dec. 23, 2011". Dec. 22 and 23, 2011. 2 pages.
Annex C2 to opposition by opponent Thermoseal Group Ltd. "Stock Control from Thermoseal Group Ltd from Jun. 8, 2011 to Dec. 22, 2011". Jun. 8, 2011-Dec. 22, 2011. 14 pages.
Annex C3 to opposition by opponent Thermoseal Group Ltd. "Invoices No. 47197, 47486 and 47812 from Lohmann of Jun. 30, 2011, Aug. 26, 2011 and Oct. 31, 2011". Jun. 30, 2011, Aug. 26, 2011, Oct. 31, 2011. 3 pages.
Annex CC1 to opposition by opponent Thermoseal Group Ltd. "Thermobar production sheets from Thermoseal Group Ltd of Aug. 8, 2011 and Sep. 26, 2011". Aug. 8, 2011 and Sep. 26, 2011. 2 pages.
Annex CC2 to opposition by opponent Thermoseal Group Ltd. "Stock Control from Thermoseal Group Ltd of Jul. 29, 2011 and Sep. 6, 2011". Jul. 29, 2011 and Sep. 6, 2011. 1 page.
Annex CC3 to opposition by opponent Thermoseal Group Ltd. "Invoice No. 47340 from Lohmann of Jul. 29, 2011". Jul. 29, 2011. 1 page.
Annex D2 to opposition by opponent Thermoseal Group Ltd. "Declaration of Ms Amanda Smith (Lohmann Segment Manager)". Jan. 18, 2014. 1 page.
Annex E to opposition by opponent Thermoseal Group Ltd. "Delivery Notes with purchase order Nos. 7621, 7684, 7756, 7757 and 7832 from Camvac Limited of May 24, 2011, Jun. 8 and 29, 2011, Jul. 22, 2011 and Aug. 18, 2011". Jul. 22, 2011 and Aug. 18, 2011. 6 pages.
Annex F1A to opposition by opponent Thermoseal Group Ltd. "Screen shot showing the last date that the 12/12 Cambrite film from Camvac data sheet was modified". Jan. 19, 2017. 1 page.
Annex F2 to opposition by opponent Thermoseal Group Ltd. "Declaration of Mr James Shipman (Camvac Process Development Manager)". Jan. 24, 2017. 2 pages.
Annex G to opposition by opponent Thermoseal Group Ltd. "Data sheet PSI values for windows having a Thermobar Warm Edge Spacer". Nov. 2014. 1 page.
Annex D1C to opposition by opponent Ensinger GmbH (Jan. 27, 2017) in European Patent 2,802,726 B1 (issued to Saint-Gobain Glass France). "Test Report, Light micrographs of two existing polished sections with the designation 2010 und 2011", Institute of Polymertechnology, Nov. 2016, 16 pages (English Translation + German Original).
Annex A7 to opposition by opponent Helima GmbH (Jan. 27, 2017) in European Patent 2,802,726 B1 (issued to Saint-Gobain Glass France). Hestermann and Rongen, "Frick/Knöll Baukonstruktionslehre 2", pp. 371-372, 1996-2013, 10 pages (English Translation + German Original).
Reply by opponent Rolltech A/S in European Patent 2,802,726 B1, issued Apr. 27, 2016 to Saint-Gobain Glass France. Mail date: Feb. 1, 2018. 8 pages.
Exhibit S27c to reply by opponent Rolltech A/S in European Patent 2,802,726 B1, issued Apr. 27, 2016 to Saint-Gobain Glass France. Sep. 12, 2017. 2 pages.
Exhibit S27d to reply by opponent Rolltech A/S in European Patent 2,802,726 B1, issued Apr. 27, 2016 to Saint-Gobain Glass France. Oct. 2010. 6 pages.
Reply by opponent Technoform Glass Insulation Holding GmbH in European Patent 2,802,726 B1, issued Apr. 27, 2016 to Saint-Gobain Glass France. Mail Date: Apr. 20, 2018. 15 pages. (English Translation + German Original).
Response by patentee Saint-Gobain Glass France to opponent's reply papers in European Patent 2,802,726 B1, issued Apr. 27, 2016 to Saint-Gobain Glass France. Mail date: Jun. 18, 2018. 32 pages (English Translation + German Original).

* cited by examiner

SPACER FOR INSULATING GLAZING UNITS, COMPRISING EXTRUDED PROFILED SEAL

CROSS REFERENCE TO RELATED APPLICATIONS

The present application is the U.S. national stage entry of International Patent Application No. PCT/EP2014/076739, filed internationally on Dec. 5, 2014, which, in turn, claims priority to European Patent Application No. 13196865.3, filed on Dec. 12, 2013.

The invention relates to a spacer with an extruded profiled seal, a method for its production, and its use.

The thermal conductivity of glass is lower by roughly a factor of 2 to 3 than that of concrete or similar building materials. However, since, in most cases, panes are designed significantly thinner than comparable elements made of brick or concrete, buildings frequently lose the greatest share of heat via external glazing. This effect is particularly significant in high-rise buildings with partial or complete glass façades. The increased costs necessary for heating and air-conditioning systems make up a part of the maintenance costs of the building that must not be underestimated. Moreover, as a consequence of more stringent construction regulations, lower carbon dioxide emissions are required. An important approach to a solution for this involves insulating glazing units, without which, primarily as a result of increasingly rapidly rising prices of raw materials and more stringent environmental protection constraints, it is no longer possible to imagine the building construction sector.

Insulating glazing units are manufactured from at least two panes that are connected to each other via at least one circumferential spacer. Depending on the embodiment, the interpane space between the two panes, referred to as the "glazing interior", is filled with air or gas, but in any case free of moisture. An excessive moisture content in the interpane space of the glazing results, in particular in the case of cold exterior temperatures, in the condensation of drops of water in the interpane space, which absolutely must be avoided. To absorb the residual moisture remaining in the system after assembly, hollow body spacers filled with a desiccant can, for example, be used. However, since the absorption capacity of the desiccant is limited, even in this case, the sealing of the system is of enormous importance to prevent the penetration of additional moisture. In the case of gas-filled insulating glazing units, into whose glazing interior an argon filling, for example, is introduced, gas tightness must also be ensured.

In order to ensure improved leak tightness of insulating glazing units, greatly varied modifications in the field of the spacers are already known. Already in DE 40 24 697 A1, the problem is discussed that customary single or double sealed insulating glass edge bonds made of materials such as polysulfide polymers, butyl hot melt, silicone rubber, polymercaptan, or polyurethane cannot ensure long-term adequate sealing and, over time, an undesirable gas exchange between the glazing interior and the environment occurs. Improved sealing is accomplished according to DE 40 24 697 A1 by means of a modification of the spacer, onto whose pane contact surfaces polyvinylidene chloride films or coatings are applied.

Another measure for improving the leak tightness of insulating glazing units is the coating of polymeric spacers with metal foils or alternating metal polymer layer systems, as disclosed, for example, in EP 0 852 280 A1 and WO 2013/104507 A1. These ensure high leak tightness of the spacer with simultaneous compatibility with the sealing materials used for assembly.

Despite these improvements in the field of spacers, leak tightness problems upon failure of the sealant between spacers and adjacent panes persist. According to the prior art, only this sealant is watering gas impermeable, whereas the outer seal of the insulating glazing unit is accomplished with materials such as silicon or polysulfide, which have very good adhesion properties but are water and gas permeable. The outer seal thus serves primarily for mechanical stability of the glazing unit. Accordingly, a defect of the sealant between the spacers and the panes results in complete failure of the insulating glazing unit. Even the prior improvements in the field of spacers, such as coated polymeric spacers, do not help since the coating seals only the spacer itself but not the glazing interior.

The object of the present invention is to provide a spacer, which results in improved sealing of insulating glazing units, an insulating glazing unit with this spacer, as well as an economical method for producing the insulating glazing unit.

The object of the present invention is accomplished according to the invention by a spacer, an insulating glazing unit with a spacer, a method for its production, and the use of the spacer according to independent claims 1, 9, 14, and 15. Preferred embodiments of the invention emerge from the subclaims.

The spacer according to the invention for insulating glazing units comprises at least a polymeric main body and an extruded profiled seal. The polymeric main body comprises two pane contact surfaces, a glazing interior surface, and an outer surface, with the extruded profiled seal applied on the outer surface of the polymeric main body. As a result of the fact that the main body and the profiled seal are coextruded, the extruded profiled seal is formed in one piece with the polymeric main body. This is particularly advantageous since the profiled seal does not have to be introduced in a separate step in the glazing plant, but, instead, the component made up of the main body and the profiled seal is already available in ready to install form. This saves time in the production process as a result of which production costs can be reduced. Since the spacer according to the invention is produced independent of the insulating glazing unit assembly line and no modifications of the production plant are required for installation of the spacer, the spacer according to the invention is universally usable without added expense. Moreover, the extruded profiled seal ensures reliable and durable sealing of the outer surface of the spacer.

Films for sealing the spacer, as known in the prior art, are, as a rule, fixed on the spacer using an adhesive, with an adhesive failure due to aging of the adhesive possibly resulting in leaks of the spacer. The coextruded spacer according to the invention is formed in one piece such that adhesive bonding is eliminated and such a failure can be avoided.

The spacer according to the invention includes, in a preferred embodiment, no additional polymeric or metallic layers, such as an insulating film, on its exterior. This is particularly advantageous since the production of the spacer according to the invention is substantially simpler and more cost-effective than coating with an insulating film, especially than coating with an insulating film with alternating metallic and polymeric layers, as is used according to the prior art in order to ensure adequate leak tightness.

The extruded profiled seal preferably protrudes laterally beyond the pane contact surfaces of the spacer. Particularly preferably, the extruded profiled seal protrudes by 0.1 mm to 2 mm, preferably 0.5 mm to 1 mm, beyond the first pane contact surface and/or the second pane contact surface. Thus, after installation of the spacer, the extruded profiled seal makes contact with the adjacent panes of the insulating glazing unit and seals the glazing interior. In order to ensure uniform centering of the spacer in the interpane space, the extruded profiled seal protrudes, preferably on the two pane contact surfaces, by the same amount beyond the polymeric main body. As a result of the flexibility of the extruded profiled seal, precisely fitted installation as well as accurate sealing are possible. Insulating films known in the prior art that are applied on the spacer cannot provide such sealing.

The two pane contact surfaces of the polymeric main body comprise a first pane contact surface and a second pane contact surface. The first pane contact surface and the second pane contact surface are the sides of the main body, onto which, at the time of installation of the spacer, the fixing of the panes (first pane and second pane) of an insulating glazing unit is done. The first pane contact surface and the second pane contact surface run parallel to each other.

The glazing interior surface is defined as the surface of the polymeric main body that faces in the direction of the interior of the glazing after installation of the spacer in an insulating glazing unit. The glazing interior surface is between the panes mounted on the spacer.

The outer surface of the polymeric main body is the side opposite the glazing interior surface, which faces away from the interior of the insulating glazing unit in the direction of an external interpane space. The outer surface preferably runs perpendicular to the pane contact surfaces. However, the outer surface nearest the pane contact surfaces can, alternatively, be inclined at an angle of preferably 30° to 60° relative to the outer surface in the direction of the pane contact surfaces. This angled geometry improves the stability of the polymeric main body. A planar outer surface, which remains perpendicular to the pane contact surfaces over its entire course has, in contrast, the advantage that the sealing surface between spacers and pane contact surfaces is maximized and simpler shaping facilitates the production process.

The spacer preferably has, along the pane contact surfaces, a height of 5 mm to 15 mm, particularly preferably of 5 mm to 10 mm.

The width of the glazing interior surface, which defines the distance between the first pane and the second pane, is 4 mm to 30 mm, preferably 8 mm to 16 mm.

The profiled seal extruded on the outer surface of the polymeric main body contains butyl rubber, polyisobutylene, polyethylene vinyl alcohol, ethylene vinyl acetate, polyolefin rubber, polypropylene, polyethylene, copolymers, and/or mixtures thereof. These materials are particularly advantageous since they are gas- and watertight and the polymeric main body as well as the glazing interior are thus sealed against the entry of atmospheric moisture as well as the escape of a filling gas (if present).

In a preferred embodiment, the penetration index of the extruded profiled seal is between 20 and 40, particularly preferably between 30 and 40. All data used here refer to the penetration index per ISO 2137-DIN 5180 measured at a temperature of 60° C. The penetration index is a measure of the hardness of the material. Accordingly, a material with a small penetration index is harder than a material with a large penetration index. Here, the selection of a harder material for producing the extruded profiled seal is particularly advantageous in order to achieve a reliable seal even at high temperatures. Soft materials with high penetration indices start to flow in the case of strong heating, as a result of which the individual components of the insulating glazing unit can shift relative to each other and/or a failure of the seal can occur. Through the use of a harder sealant material, this is prevented.

The thickness of the extruded profiled seal is 0.5 mm to 5 mm, preferably 1 mm to 2 mm.

The polymeric main body contains polyethylene (PE), polycarbonates (PC), polypropylene (PP), polystyrene, polybutadiene, polynitriles, polyesters, polyurethanes, polymethyl methacrylates, polyacrylates, polyamides, polyethylene terephthalate (PET), polybutylene terephthalate (PBT), preferably acrylonitrile butadiene styrene (ABS), acrylonitrile styrene acrylester (ASA), acrylonitrile butadiene styrene/polycarbonate (ABS/PC), styrene acrylonitrile (SAN), PET/PC, PBT/PC, and/or copolymers or mixtures thereof.

Preferably, the polymeric main body is glass fiber reinforced. By means of the selection of the glass fiber content in the main body, the coefficient of thermal expansion of the main body can be varied and adapted. Through adaptation of the coefficient of thermal expansion of the polymeric main body and of the extruded profiled seal, temperature-related stresses between the various materials and flaking of the extruded profiled seal can be prevented. This is the case particularly with hard materials with a low penetration index, such as, for example, polypropylene or polyethylene. The main body preferably has a glass fiber content of 20% to 50%, particularly preferably of 30% to 40%. The glass fiber content in the polymeric main body simultaneously improves strength and stability.

Preferably, the polymeric main body is designed as a hollow profile, with, on the one hand, a weight reduction compared to a solidly formed spacer being possible, and, on the other, a hollow chamber being available in the interior of the main body to accommodate additional components, such as, a desiccant.

In a preferred embodiment, the glazing interior surface has at least one opening. Preferably, a plurality of openings are made. The total number of openings depends on the size of the insulating glazing unit. The openings connect the hollow chamber to the interpane space, as a result of which a gas exchange is possible therebetween. This enables absorption of atmospheric moisture by a desiccant situated in the hollow chambers and thus prevents fogging of the pane. The openings are preferably implemented as slits, particularly preferably as slits with a width of 0.2 mm and a length of 2 mm. The slits ensure optimal air exchange without the desiccant being able to penetrate out of the hollow chambers into the interpane spaces.

The polymeric main body preferably contains a desiccant, preferably silica gels, molecular sieves, $CaCl_2$, $Na_2SO_4$, activated carbon, silicates, bentonites, zeolites, and/or mixtures thereof. The desiccant is preferably incorporated into the main body. The desiccant is particularly preferably situated in the hollow chamber of the main body.

The invention further includes an insulating glazing unit with a spacer according to the invention. The insulating glazing unit comprises at least one first pane, a second pane, and a circumferential spacer according to the invention surrounding the panes. The glazing interior of the insulating glazing unit is situated adjacent the glazing interior surface of the spacer. On the other hand, the outer surface of the spacer, on which the extruded profiled seal is fixed, is adjacent the external interpane space. The first pane fixed on the first pane contact surface of the spacer and the second pane on the second contact surface of the spacer.

The two panes are fixed on the pane contact surfaces preferably via a sealant, which is applied between the first pane contact surface and the first pane and/or the second pane contact surface and the second pane.

The sealant preferably contains butyl rubber, polyisobutylene, polyethylene vinyl alcohol, ethylene vinyl acetate, polyolefin rubber, polypropylene, polyethylene, copolymers, and/or mixtures thereof. The sealant is gas- and watertight such that the glazing interior is sealed against the entry of atmospheric moisture as well as the escape of a filling gas (if present).

The sealant is preferably introduced with a thickness of 0.1 mm to 0.8 mm, particularly preferably 0.2 mm to 0.4 mm into the gap between the spacer and the panes.

The external interpane space of the insulating glazing unit is preferably filled with an outer seal. This outer seal serves mainly for the bonding of the two panes and thus for the mechanical stability of the insulating glazing unit.

The outer seal preferably contains polysulfides, silicones, silicone rubber, polyurethanes, polyacrylates, copolymers, and/or mixtures thereof. Such materials have very good adhesion on glass such that the outer seal ensures reliable bonding of the panes.

The thickness of the outer seal is preferably 2 mm to 30 mm, particularly preferably 5 mm to 10 mm.

The insulating glazing unit according to the invention thus includes a triple sealing of the glazing interior consisting of the sealant between the spacer and panes as a primary sealant, the extruded profiled seal on the spacer as a secondary sealant, and the outer seal as a tertiary sealant. An insulating glazing unit according to the prior art includes, in contrast, only one sealant between the spacer and the panes as well as an outer seal and is thus only doubly sealed. However, the outer seal is not a barrier to gases and water vapor such that the seal of a known insulating glazing unit according to the prior art fails completely as soon as the sealant between the spacer and panes has a leak. Even when a spacer according to the prior art additionally includes an insulating film on the exterior of the polymeric main body, this only serves for sealing the spacer and does not contribute to the sealing of the glazing interior. In contrast, the extruded profiled seal of the spacer according to the invention contacts the panes of the insulating glazing unit such that the glazing interior is additionally sealed. Thus, the insulating glazing unit according to the invention has redundant sealing of the glazing interior. In the event of a possible failure of the sealant between the spacer and the panes or a leak of the spacer, the error-free functioning of the insulating glazing unit is thus still ensured. By this means, the service life of the insulating glazing unit according to the invention can be substantially improved compared to the systems known according to the prior art.

The sealant between the spacer and panes has a penetration index of 45 to 100, preferably 50 to 70. The selection of such a soft sealant is, among other things, advantageous in processing. To that end, a strand of the sealant is applied on the pane contact surfaces of the spacer and pressed with the panes. The sealant fills the gap between the panes and the spacer over its entire area. This can be achieved only through the selection of a soft material. Since soft materials with high penetration indices start to flow in the event of strong heating, the individual components of the insulating glazing unit can shift relative to each other and/or a failure of the seal can occur. However, even if the sealant fails, the spacer according to the invention remains fixed in its position by the secondary sealant and the glazing interior remains sealed. Accordingly, the combination of a sealant with a high penetration index and an extruded profiled seal with a lower penetration index enables particularly reliable redundant sealing that withstands even strong heating.

The glazing interior of the insulating glazing unit is preferably filled with a protective gas, preferably with a noble gas, preferably argon or krypton, which reduce the heat transfer value in the insulating glazing unit interpane space.

In a possible embodiment, the insulating glazing unit includes more than two panes.

In that case, for example, a third pane, for example, can be fixed in or on the spacer between the first pane and the second pane. In this embodiment, only a single spacer is used, which bears an extruded profile seal on its exterior.

Alternatively, a plurality of spacers can also be used. In this case, an additional spacer is fixed on the first pane and/or the second pane parallel to the spacer situated between the first and second pane. According to this embodiment, the insulating glazing unit has a plurality of spacers according to the invention with an extruded profiled seal.

The first pane and the second pane of the insulating glazing unit contain glass and/or polymers, preferably quartz glass, borosilicate glass, soda lime glass, polymethyl methacrylate, and/or mixtures thereof. Possible additional panes likewise include these materials, with the composition of the panes also possibly being different.

The panes of the insulating glazing unit according to the invention have a thickness of 1 mm to 50 mm, preferably 3 mm to 16 mm, particularly preferably 3 mm to 10 mm, with the two panes also possibly having different thicknesses.

At the corners of the insulating glazing unit, two spacers provided with a miter cut abut. According to the prior art, these are linked via corner connectors with a gasket to obtain sealing of the frame. Since the spacer according to the invention has an extruded profiled seal, the additional use of corner connectors is unnecessary. The extruded profiled seals of the adjacent spacers have strong reciprocal adhesion such that the extruded profiled seals bond to each other at the abutment site. This yields adequate sealing of the spacer frame profile even without additional measures such as corner connectors.

In the event that redundant sealing is also desired in the region of the corners, in another embodiment, the corners of the insulating glazing unit can be additionally equipped with corner connectors to ensure additional reliability. Alternatively, the corners can also be molded with an additional butyl gasket for this purpose.

Corner connectors can, for example, be implemented as molded plastic parts with a gasket, wherein two spacers provided with a miter cut abut. The corner connectors likewise include, according to the prior art, a gasket which is pressed together at the time of assembly of the individual parts and thus sealed.

In principle, extremely varied geometries of the insulating glazing unit are possible, for example, rectangular, trapezoidal, and rounded shapes. To produce round geometries, the spacer can, for example, be bent in a heated state.

Any abutment sites of the spacer frame profile are, as already discussed for corner connectors, likewise adequately sealed via the extruded profiled seal of the spacer according to the invention. Redundant sealing can also be done at these abutment sites, for example, by molding the abutment sites with an additional butyl gasket.

The invention further includes a method for producing an insulating glazing unit according to the invention comprising the steps:

a) Coextrusion of a spacer composed of a polymeric main body and an extruded profiled seal,
b) Fixing the spacer between a first pane and a second pane via, in each case, a pane contact surface of the spacer by means of a sealant,
c) Pressing the pane arrangement,
d) Introducing an outer seal into the external interpane space.

In step b), the sealant is applied preferably as a strand, for example, with a diameter of 1 mm to 2 mm, on the pane contact surfaces. At the time of the pressing of the pane arrangement, this strand is uniformly distributed in the gap between the pane contact surface and the adjacent pane, resulting in the sealing of the gap.

In step d), the outer seal is preferably extruded directly into the external interpane space.

Preferably, the glazing interior between the panes is filled with a protective gas before the pressing of the arrangement (step c)).

The invention further includes the use of a spacer according to the invention in multiple glazings, preferably in insulating glazing units, particularly preferably in double or triple insulating glazing units. Use in combination with other elements, such as lighting elements, heating elements, antenna elements, or electrically switchable glazings, such as displays or electrochromic glazings, is also possible. In such glazings, a power supply is required in the glazing interior such that an electric conductor, such as a connection element, protrudes from the external interpane space into the glazing interior. In a possible embodiment, the insulating glazing unit has a connection element whose outer end protrudes out of the outer seal and is electrically contactable there and whose inner end contacts the electrically switchable element in the glazing interior. The connection element penetrates through the outer seal, runs between between the extruded profiled seal of the spacer contacting the pane and the adjacent pane and penetrates through the sealant between the pane contact surface and the adjacent pane.

Figure 1B:
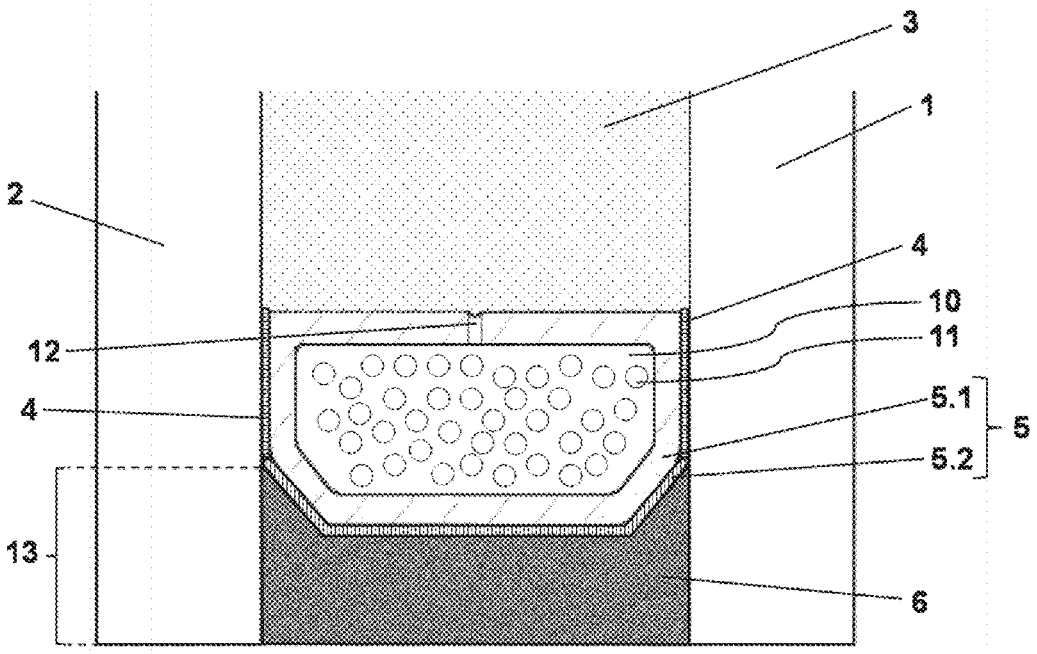
Figure 2:
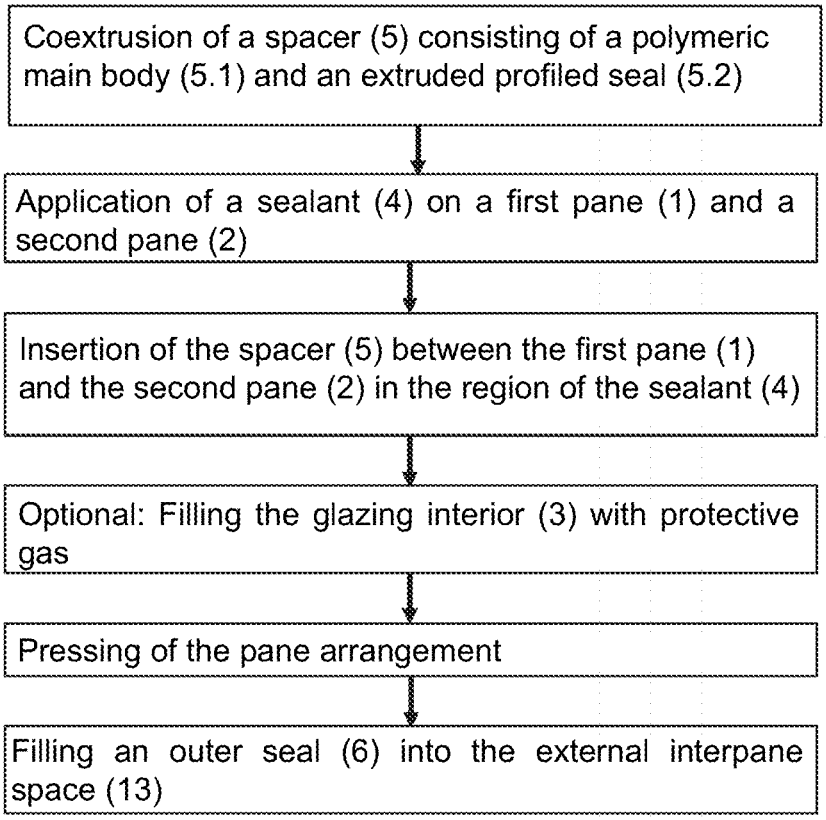

In the following, the invention is explained in detail with reference to drawings. The drawings are purely schematic and not true to scale. They in no way restrict the invention. They depict:

FIG. 1*a* a schematic representation of the spacer according to the invention, FIG. 1*b* a schematic representation of the insulating glazing unit according to the invention with a spacer in accordance with FIG. 1*a*, FIG. 2 a flowchart of one possible embodiment of the method according to the invention.

FIG. 1*a* depicts a schematic representation of the spacer (5) according to the invention comprising a polymeric main body (5.1) and an extruded profiled seal (5.2). The polymeric main body (5.1) is a hollow body profile comprising two pane contact surfaces (7.1, 7.2), a glazing interior surface (8), an outer surface (9), and a hollow chamber (10). The polymeric main body (5.1) contains styrene acrylonitrile (SAN) and roughly 35 wt.-% glass fiber. The outer surface (9) has an angled shape, wherein the sections of the outer surface adjacent the pane contact surfaces (7.1, 7.2) are inclined at an angle of 30° relative to the pane contact surfaces (7.1, 7.2). This improves the stability of the glass fiber reinforced polymeric main body (5.1). The hollow body (10) is filled with a desiccant (11). A molecular sieve is used as the desiccant (11). The glazing interior surface (8) of the spacer (5) has openings (12), which are made at regular intervals circumferentially along the glazing interior surface (8) in order to enable a gas exchange between the interior of the insulating glazing unit and the hollow chamber (10). Thus, atmospheric moisture possibly present in the interior is absorbed by the desiccant (11). The openings (12) are implemented as slits with a width of 0.2 mm and a length of 2 mm. The extruded profiled seal (5.2) is applied on the outer surface (9) of the polymeric main body (5.1), with the polymeric main body (5.1) and the extruded profiled seal (5.2) being coextruded. The extruded profiled seal (5.2) is made of polyisobutylene with a penetration index of 36 and a thickness of 1 mm. The extruded profiled seal (5.2) protrudes beyond the first pane contact surface (7.1) and the second pane contact surface (7.2) by 0.8 mm in each case.

FIG. 1*b* depicts an insulating glazing unit according to the invention with a spacer in accordance with FIG. 1*a*. The spacer (5) according to the invention is fixed circumferentially between a first pane (1) and a second pane (2) via a sealant (4). The sealant (4) bonds the pane contact surfaces (7.1, 7.2) of the spacer (5) to the panes (1, 2). The glazing interior (3) adjacent the glazing interior surface (8) of the spacer (5) is defined as the space delimited by the panes (1, 2) and the spacer (5). The external interpane space (13) adjacent the outer surface (9) of the spacer (5) is a strip-shaped circumferential section of the glazing, which is delimited by one side each of the two panes (1, 2) and on another side by the spacer (5) and whose fourth edge is open. The glazing interior (3) is filled with argon. A sealant (4) with a thickness of 0.2 mm is introduced in each case, between a pane contact surface (7.1, 7.2) and the adjacent pane (1, 2), which sealant seals the gap between the pane (1, 2) and the spacer (5). The sealant (4) is polyisobutylene with a penetration index of 50-70. The extruded profiled seal (5.2) contacts the adjacent panes (1, 2), since it protrudes beyond the pane contact surfaces (7.1, 7.2) of the spacer (5), as described in FIG. 1*a*. An outer seal (6) which serves for the bonding of the first pane (1) and the second pane (2) is fixed on the extruded profiled seal (4) in the external interpane space (13). The outer seal (6) is made of silicone, which is inserted in a thickness of 10 mm into the external interpane space (14). The outer seal (6) ends flush with the pane edges of the first pane (1) and the second pane (2). The outer seal (6) is permeable to gas and water, but is, due to its very good adhesion on glass, of enormous importance for the mechanical stability of the insulating glazing unit. The use of the spacer (5) according to the invention is particularly advantageous since the extruded profiled seal (5.2) is rigid enough to lock the spacer between the panes (1, 2) and thus to fix it in its position even in the event of a possible failure of the sealant (4). On the other hand, the extruded profiled seal (5.2) is flexible enough to give way at the time of pressing of the pane arrangement. Since the extruded profiled seal (5.2) covers the external interpane space (13) over its entire surface and contacts the two panes (1, 2), it also serves for additional sealing of the glazing interior (3) such that its leak tightness can be ensured even in the event of failure of the sealant (4). Thus, the service life of the insulating glazing unit can be decisively increased. At the same time, the spacer (5) according to the invention is simple to use, since the installation of the spacer (5) can be done without modification of the tools and plants used according to the prior art such that no investments are to be made at the time of a changeover in production.

FIG. 3 depicts a flowchart of one possible embodiment of the method according to the invention. First, a spacer (5) composed of a polymeric main body (5) and an extruded profiled seal (5.2) is coextruded. This spacer (5) is fixed via a sealant (4) between a first pane (1) and a second pane (2), with the sealant (4) being introduced between the pane contact surfaces (7.1, 7.2) of the spacer (5) and the panes (1, 2). The glazing interior (3) can optionally be filled with a protective gas. At the time of subsequent pressing of the pane arrangement, the sealant (4) is distributed uniformly in the gap between the spacer (5) and the adjacent pane pane (1, 2) and seals it. The sealant (4) is applied, for example, as a round strand of 1 mm to 2 mm diameter and has, after pressing, a thickness of, for example, 0.2 mm. To support such processing, it is advantageous to use a soft material with a penetration index of 45 to 100 as sealant (4). Then, an outer seal (6) is introduced adjacent the extruded profiled seal (5.2) into the external interpane space (13), with the outer seal (6) ending flush with the edges of the panes (1, 2). The outer seal (6) is preferably extruded directly into the external interpane space (13).

LIST OF REFERENCE CHARACTERS

1 first pane
2 second pane
3 glazing interior
4 sealant
5 spacer
5.1 polymeric main body
5.2 extruded profiled seal
6 outer seal
7 pane contact surfaces
7.1 first pane contact surface
7.2 second pane contact surface
8 glazing interior surface
9 outer surface
10 hollow chamber
11 desiccant
12 openings
13 external interpane space

The invention claimed is:

1. An insulating glazing unit, comprising:
a first pane;
a second pane;
a spacer, the spacer being a circumferential spacer surrounding the first pane and the second pane, the spacer comprising
i) a polymeric main body that comprises a first pane contact surface and a second pane contact surface;
ii) a glazing interior surface;
iii) an outer surface; and
iv) an extruded profiled seal on the outer surface,
wherein the extruded profiled seal and the polymeric main body are coextruded,
wherein the extruded profiled seal protrudes laterally beyond the pane contact surfaces of the polymeric main body and makes contact with first pane and second pane, and
wherein the extruded profiled seal has a penetration index between 20 and 40;
a glazing interior adjacent the glazing interior surface of the spacer; and
an external interpane space adjacent the outer surface of the spacer,
wherein:
the first pane contacts the first pane contact surface of the spacer,
the second pane contacts the second pane contact surface of the spacer,
a sealant is fixed between at least one of the first pane contact surface and the first pane and the second pane contact surface and the second pane, and
the sealant has a penetration index between 45 to 100.

2. The insulating glazing unit according to claim 1, further comprising an outer seal inserted in the external interpane space.

3. The insulating glazing unit according to claim 2, wherein the outer seal contains a component selected from the group consisting of: a) polysulfides, b) silicones, c) silicone rubber, d) polyurethanes, e) polyacrylates, f) copolymers of one or more of a)-e), and g) mixtures of one or more of a)-f).

4. The insulating glazing unit according to claim 1, wherein the first pane and the second pane contain glass and/or polymers.

5. A method for producing the insulating glazing unit according to claim 1, comprising:
coextruding a spacer consisting of a polymeric main body and an extruded profiled seal,
fixing the spacer by way of a sealant via a pane contact surface between a first pane and a second pane,
performing a pressing operation, and
introducing an outer seal into the external interpane space.

6. The insulating glazing unit according to claim 1, wherein the extruded profiled seal contains a component selected from the group consisting of: a) butyl rubber, b) polyisobutylene, c) polyethylene vinyl alcohol, d) ethylene vinyl acetate, e) polyolefin rubber, f) polypropylene, g) polyethylene, h) copolymers, and i) mixtures of one or more of a)-h).

7. The insulating glazing unit according to claim 1, wherein a thickness of the extruded profiled seal is 0.5 mm to 5 mm.

8. The insulating glazing unit according to claim 1, wherein the polymeric main body contains components selected from the group consisting of: a) polyethylene (PE), b) polycarbonates (PC), c) polypropylene (PP), d) polystyrene, e) polybutadiene, f) polynitriles, g) polyesters, h) polyurethanes, i) polymethyl methacrylates, polyacrylates, j) polyamides, k) polyethylene terephthalate (PET), and l) polybutylene terephthalate (PBT), and m) copolymers or mixtures of one or more of a)-l).

9. The insulating glazing unit according to claim 1, wherein the polymeric main body contains components selected from the group consisting of: a) acrylonitrile butadiene styrene (ABS), b) acrylonitrile styrene acrylester (ASA), c) acrylonitrile butadiene styrene/polycarbonate (ABS/PC), d) styrene acrylonitrile (SAN), PET/PC, PBT/PC, and e) copolymers or mixtures of one or more of a)-d).

10. The insulating glazing unit according to claim 1, wherein the polymeric main body includes at least one hollow chamber.

11. The insulating glazing unit according to claim 9, wherein the glazing interior surface has one or more openings connecting the hollow chamber to a glazing interior.

12. The insulating glazing unit according to claim 1, wherein the polymeric main body contains a desiccant.

* * * * *